US011433671B2

(12) United States Patent
Hagiwara et al.

(10) Patent No.: US 11,433,671 B2
(45) Date of Patent: Sep. 6, 2022

(54) LIQUID EJECTING HEAD UNIT

(71) Applicant: SEIKO EPSON CORPORATION, Tokyo (JP)

(72) Inventors: Hiroyuki Hagiwara, Matsumoto (JP); Katsuhiro Okubo, Azumino (JP); Takahiro Kanegae, Shiojiri (JP); Keita Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 17/001,225

(22) Filed: Aug. 24, 2020

(65) Prior Publication Data

US 2021/0060943 A1 Mar. 4, 2021

(30) Foreign Application Priority Data

Aug. 27, 2019 (JP) ..... JP2019-154262

(51) Int. Cl.
*B41J 2/14* (2006.01)

(52) U.S. Cl.
CPC ..... *B41J 2/1433* (2013.01); *B41J 2/14201* (2013.01); *B41J 2002/14419* (2013.01)

(58) Field of Classification Search
CPC ..... B41J 2/175; B41J 2/1433; B41J 2/14024; B41J 2/18; B41J 2/14145; B41J 2/14201; B41J 2002/14419; B41J 2202/12; B41J 2002/14362; B41J 2202/19; B41J 2202/20
See application file for complete search history.

(56) References Cited

U.S. PATENT DOCUMENTS

| | | | | |
|---|---|---|---|---|
| 8,171,635 | B2 * | 5/2012 | Kobayashi | B41J 2/175 29/890.1 |
| 10,118,394 | B2 * | 11/2018 | Munakata | B41J 2/16532 |
| 10,449,766 | B2 * | 10/2019 | Hanagami | B41J 2/1634 |
| 10,556,437 | B2 * | 2/2020 | Nakajima | B41J 2/14233 |
| 11,110,708 | B2 * | 9/2021 | Kanegae | B41J 2/2103 |

FOREIGN PATENT DOCUMENTS

JP 2017-136720 8/2017

* cited by examiner

*Primary Examiner* — An H Do
(74) *Attorney, Agent, or Firm* — Workman Nydegger

(57) ABSTRACT

A liquid ejecting head unit configured to eject a liquid includes a flow channel member, and a liquid ejecting head configured to eject the liquid supplied from the flow channel member, in which the flow channel member includes a flow channel structure having a supply flow channel through which the liquid supplied from the outside flows, and a supply protrusion that protrudes from the flow channel structure and has a supply port for supplying the liquid from the outside to the supply flow channel, a wall surface of the supply flow channel is made of a resin, and at least a part of the supply protrusion is made of a metal.

8 Claims, 14 Drawing Sheets

LIQUID EJECTING HEAD UNIT

The present application is based on, and claims priority from JP Application Serial Number 2019-154262, filed Aug. 27, 2019, the disclosure of which is hereby incorporated by reference herein in its entirety.

BACKGROUND

1. Technical Field

The present disclosure relates to a liquid ejecting head unit.

2. Related Art

Liquid ejecting apparatuses for ejecting liquid such as ink onto a medium such as printing paper have been proposed. For example, JP-A-2017-136720 discloses a liquid ejecting apparatus that has a liquid ejecting head for ejecting a liquid and a flow channel member that has a flow channel for supplying the liquid to the liquid ejecting head.

Some known flow channel members have protrusions that protrude from a flow channel member for coupling to tubes for ink supply, or the like. Typical protrusions are made of resin and integrally formed with a flow channel member. When the protrusions are made of resin, however, the use of, for example, a solvent ink or an ultraviolet (UV) ink (ultraviolet curing UV ink) causes reduction in strength of the protrusions. Accordingly, in the case of the resin protrusions, for example, in coupling tubes to the protrusions, the protrusions may be damaged due to the stress applied to the protrusions.

SUMMARY

According to an aspect of the present disclosure to solve the above-mentioned problem, a liquid ejecting head unit configured to eject a liquid includes a flow channel member, and a liquid ejecting head configured to eject the liquid supplied from the flow channel member, in which the flow channel member includes a flow channel structure having a supply flow channel through which the liquid supplied from the outside flows, and a supply protrusion that protrudes from the flow channel structure and has a supply port for supplying the liquid from the outside to the supply flow channel, a wall surface of the supply flow channel is made of a resin, and at least a part of the supply protrusion is made of a metal.

According to another aspect of the present disclosure, a liquid ejecting head unit configured to eject a liquid include a flow channel member, and a liquid ejecting head configured to eject the liquid supplied from the flow channel member, in which the flow channel member includes a flow channel structure having a discharge flow channel through which the liquid to be discharged to the outside flows, and a discharge protrusion that protrudes from the flow channel structure and has a discharge port for discharging the liquid from the discharge flow channel to the outside, a wall surface of the discharge flow channel is made of a resin, and at least a part of the discharge protrusion is made of a metal.

DESCRIPTION OF EXEMPLARY EMBODIMENTS

Figure 2:
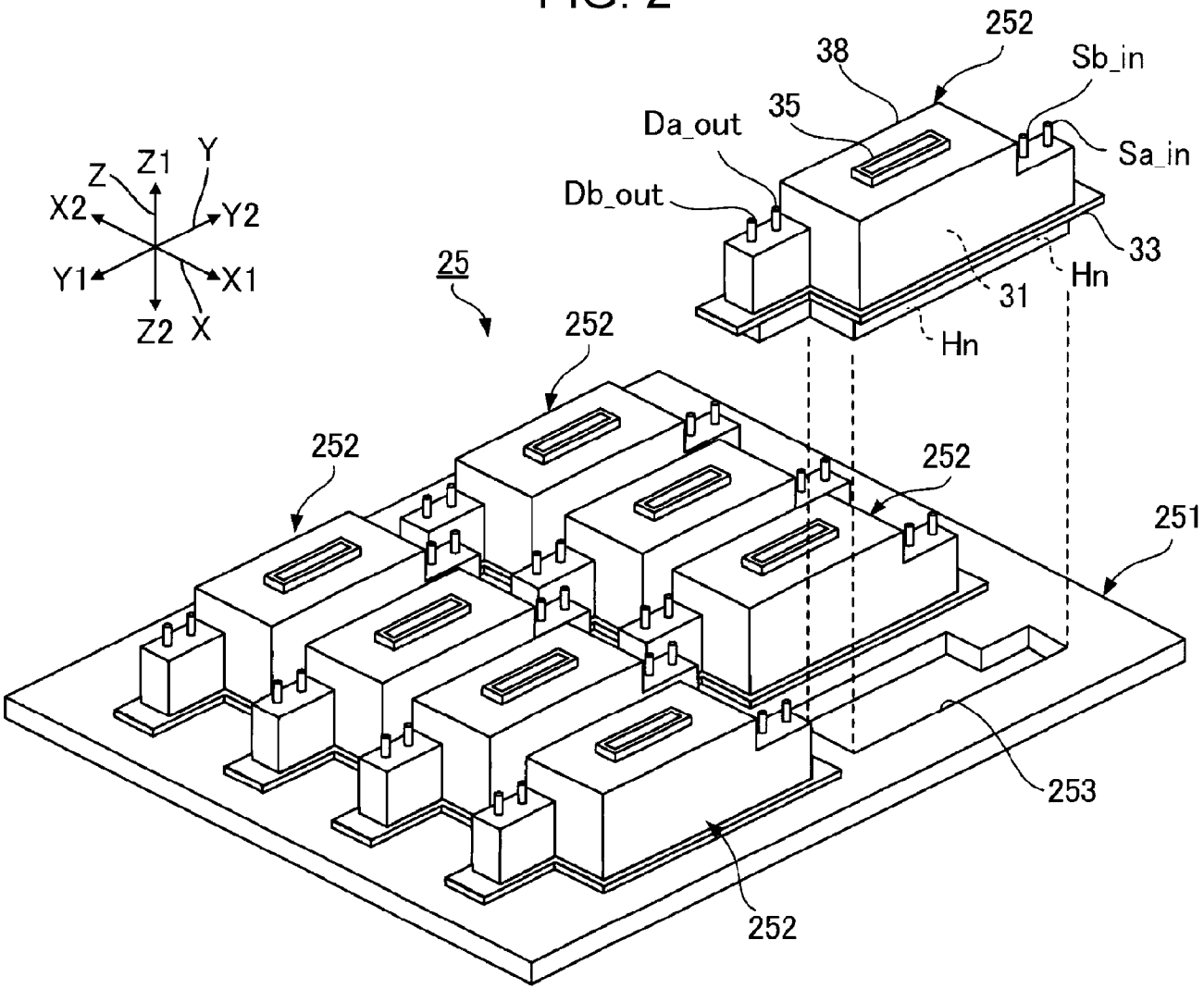
FIG. 2 is a perspective view illustrating a head module.

In the following description, it is assumed that an X axis, a Y axis, and a Z axis are orthogonal to each other. As illustrated in FIG. 2, one direction along the X axis viewed from a point is denoted by a X1 direction, and the direction opposite to the X1 direction is denoted by X2 direction. Similarly, directions opposite to each other along the Y axis from a point are denoted by a Y1 direction and a Y2 direction respectively, and directions opposite to each other along the Z axis from a point are denoted by a Z1 direction and a Z2 direction respectively. An X-Y plane including the X axis and the Y axis corresponds to a horizontal plane. The Z axis is an axis along a vertical direction, and the Z2 direction corresponds to a lower side in the vertical direction. The X axis, the Y axis, and the Z axis intersect with each other at an angle of approximately 90 degrees. In the accompanying drawings, the dimensions and scale of components may be different from actual ones, and some parts may be schematically illustrated to facilitate understanding.

1. First Embodiment

1-1. Overall Structure of Liquid Ejecting Apparatus 100

Figure 1:
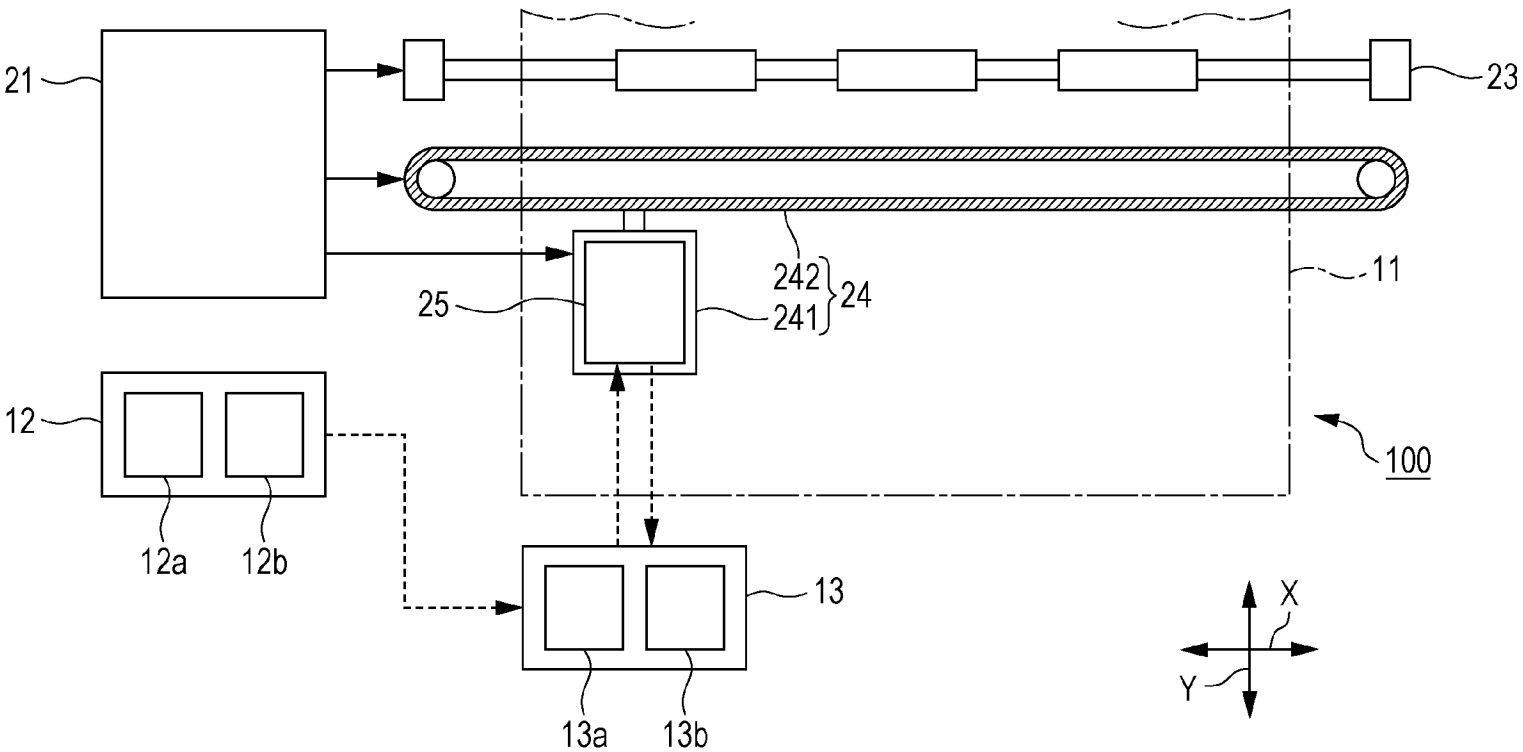
FIG. 1 is a block diagram illustrating a structure of a liquid ejecting apparatus according to a first embodiment.

FIG. 1 illustrates a structure of a liquid ejecting apparatus 100 according to a first embodiment. The liquid ejecting apparatus 100 is an ink jet printing apparatus that ejects droplets of an ink, which is an example liquid, onto a medium 11. The medium 11 is typically printing paper. Alternatively, the medium 11 may be a print target of any material such as a plastic film or cloth. The ink may be, for example, a UV ink or a solvent ink. The solvent ink contains an organic solvent. The UV ink contains an ultraviolet curable monomer or the like.

As illustrated in FIG. 1, the liquid ejecting apparatus 100 includes a liquid container 12 for storing an ink. The liquid container 12 may be a cartridge that is detachably attached to the liquid ejecting apparatus 100, a pouch-shaped ink pack made of a flexible film, or an ink tank that can be refilled with an ink. As illustrated in FIG. 1, the liquid container 12 includes a first liquid container 12*a* and a second liquid container 12*b*. The first liquid container 12*a* stores a first ink, and the second liquid container 12*b* stores a second ink. The first ink and the second ink are inks of different types. For example, the first ink is a cyan ink and the second ink is a magenta ink.

To the liquid ejecting apparatus 100, a sub tank 13 for temporarily storing an ink is provided. The sub tank 13 stores an ink supplied from the liquid container 12. The sub tank 13 includes a first sub tank 13*a* that stores the first ink and the second sub tank 13*b* that stores the second ink. The first sub tank 13*a* is coupled to the first liquid container 12*a* and the second sub tank 13*b* is coupled to the second liquid container 12*b*. The sub tank 13 is coupled to a head module 25, supplies the ink to the head module 25, and collects the ink from the head module 25. The ink flow between the sub tank 13 and the head module 25 will be described in detail below.

As illustrated in FIG. 1, the liquid ejecting apparatus 100 includes a control unit 21, a transport mechanism 23, a moving mechanism 24, and the head module 25. The control unit 21 is an example "controller". The control unit 21 controls components in the liquid ejecting apparatus 100. The control unit 21 includes, for example, at least one processing circuit such as a central processing unit (CPU) or a field-programmable gate array (FPGA), and at least one storage circuit such as a semiconductor memory.

The transport mechanism 23 transports a medium 11 along the Y axis under the control of the control unit 21. The moving mechanism 24 reciprocates the head module 25 along the X axis under the control of the control unit 21. The moving mechanism 24 according to the embodiment includes a substantially box-shaped transport member 241 that accommodates the head module 25, and an endless belt 242 with the transport member 241 fixed thereto. The liquid container 12 and the sub tank 13 may be disposed in the transport member 241 together with the head module 25.

The head module 25 discharges the inks supplied from the sub tank 13 onto the medium 11 from a plurality of nozzles under the control of the control unit 21. The head module 25 discharges the inks onto the medium 11 simultaneously with the transport of the medium 11 by the transport mechanism 23 and the reciprocating motion of the transport member 241, and thereby an image is formed on the medium 11. The inks that have not been discharged from the nozzles are discharged to the sub tank 13.

The sub tank 13 according to the embodiment is a part of an external flow channel (not illustrated) that is disposed outside the head module 25. The external flow channel includes a flow channel that couples the head module 25 and the sub tank 13, and a circulation pump that sends the inks from the head module 25 to the sub tank 13.

1-2. Overall Structure of Head Module 25

FIG. 2 is a perspective view illustrating the head module 25. As illustrated in FIG. 2, the head module 25 includes a supporting member 251 and a plurality of head units 252. The head units 252 are an example "liquid ejecting head unit". The supporting member 251 is a plate-shaped member for supporting the head units 252. The supporting member 251 has a plurality of mounting holes 253. Each of the head units 252 are mounted in the mounting holes 253 and supported by the supporting member 251. The head units 252 are arranged in a matrix along the X axis and the Y axis. It should be noted that the number of the head units 252 and the arrangement of the head units 252 are not limited to the above-described example.

1-3. Overall Structure of Head Unit 252

Figure 3:
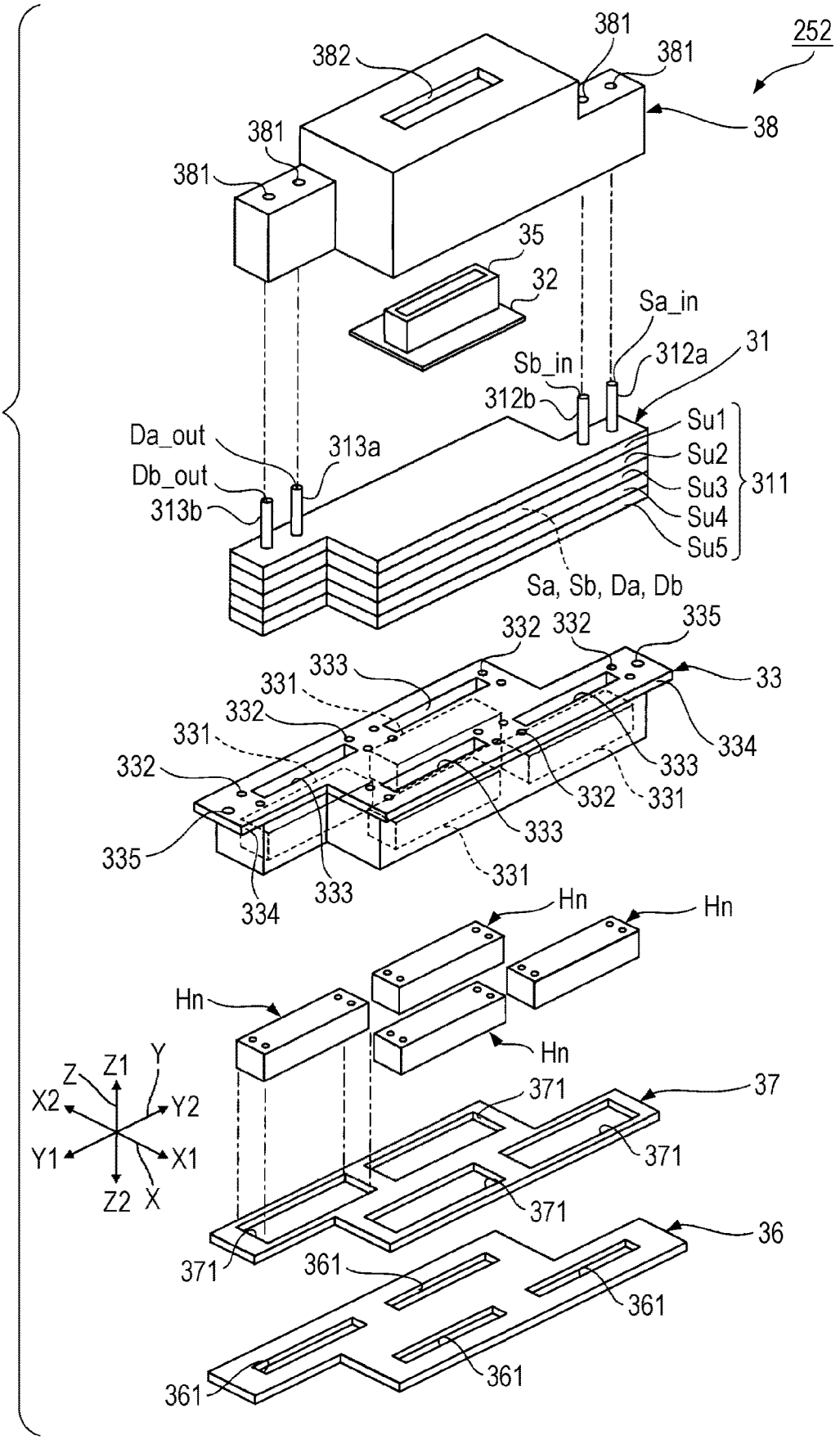
FIG. 3 is an exploded perspective view illustrating a liquid ejecting unit.

FIG. 3 is an exploded perspective view illustrating the head unit 252. As illustrated in FIG. 3, the head unit 252 includes a flow channel member 31, a wiring board 32, a holder 33, a plurality of circulation heads Hn, a fixing plate 36, a reinforcement plate 37, and a cover 38. The flow channel member 31 is disposed between the wiring board 32 and the holder 33. The circulation heads Hn are an example "liquid ejecting head".

The flow channel member 31 has flow channels through which inks flow. The flow channel member 31 includes a flow channel structure 311, a first supply protrusion 312*a*, a second supply protrusion 312*b*, a first discharge protrusion 313*a*, and a second discharge protrusion 313*b*. The first supply protrusion 312*a* is an example "supply protrusion". The second supply protrusion 312*b* is an example "supply protrusion". The first discharge protrusion 313*a* is an example "discharge protrusion". The second discharge protrusion 313*b* is an example "discharge protrusion".

The flow channel structure 311 includes a substrate Su1, a substrate Su2, a substrate Su3, a substrate Su4, and a substrate Su5, which are stacked. The substrate Su1 is an uppermost layer in the vertical direction, and the substrate Su5 is a lowermost layer in the vertical direction. The substrates Su1, Su2, Su3, Su4, and Su5 contain, for example, a resin, and are joined to each other with an adhesive. In the following description, when it is not necessary to distinguish the substrates Su1, Su2, Su3, Su4, and Su5 from each other, they are referred to as substrates Su. The substrates Su are formed, for example, by injection molding.

In the flow channel structure 311 illustrated in FIG. 3, a flow channel for supplying an ink stored in the sub tank 13 illustrated in FIG. 1 to the circulation heads Hn and a flow channel for discharging the ink that has not been discharged from the circulation heads Hn to the sub tank 13 are provided. More specifically, in the flow channel structure 311, a first supply flow channel Sa, a second supply flow channel Sb, a first discharge flow channel Da, and a second discharge flow channel Db are provided. The first supply flow channel Sa is a "supply flow channel" through which a first ink supplied from the first sub tank 13*a* flows. The second supply flow channel Sb is a "supply flow channel" through which a second ink supplied from the second sub tank 13*b* flows. The first discharge flow channel Da is a "discharge flow channel" through which the first ink to be discharged to the first sub tank 13*a* flows. The second discharge flow channel Db is a "discharge flow channel" through which the second ink to be discharged to the second sub tank 13*b* flows.

As illustrated in FIG. 3, each of the first supply protrusion 312*a*, the second supply protrusion 312*b*, the first discharge protrusion 313*a*, and the second discharge protrusion 313*b* protrudes from the flow channel structure 311 in the Z1 direction. The first supply protrusion 312*a* is a supply pipe that has a first supply port Sa_in for supplying the first ink from the first sub tank 13*a* to the first supply flow channel Sa. The first supply port Sa_in is an example "supply port". The second supply protrusion 312*b* is a supply pipe that has a second supply port Sb_in for supplying the second ink from the second sub tank 13*b* to the second supply flow channel Sb. The second supply port Sb_in is an example "supply port". The first discharge protrusion 313*a* is a discharge pipe that has a first discharge port Da_out for discharging the first ink from the first discharge flow channel Da to the first sub tank 13*a*. The first discharge port Da_out is an example "discharge port". The second discharge protrusion 313*b* is a discharge pipe that has a second discharge port Db_out for discharging the second ink from the second sub tank 13*b* to the second supply flow channel Db. The second discharge port Db_out is an example "discharge port".

The wiring board 32 illustrated in FIG. 3 is a mounting component that is used to electrically couple the head unit 252 to the control unit 21 illustrated in FIG. 1. The wiring board 32 is disposed on the flow channel member 31. On the wiring board 32, the connector 35 is disposed. The connector 35 is a connection component that is used to electrically couple the head unit 252 to the control unit 21. Although not illustrated, to the wiring board 32, wires that are coupled to the circulation heads Hn are coupled. The wires and the wiring board 32 may be integrated.

As illustrated in FIG. 3, the holder 33 is a structure that accommodates and supports the circulation heads H1, H2, H3, and H4. In the following description, when it is not necessary to distinguish the circulation heads H1, H2, H3, and H4 from each other, they are referred to as circulation heads Hn. The holder 33 is made of, for example, a resin material or a metal material. The holder 33 has recessed portions 331, ink holes 332, and wiring holes 333. In the recessed portions 331, the circulation heads Hn are disposed. Each ink hole 332 is a flow channel through which an ink flows between the flow channel member 31 and the circulation head Hn. Each wiring hole 333 is a hole in which a wire (not illustrated) for coupling the circulation head Hn and the wiring board 32 is disposed. The holder 33 has a flange 334 for fixing the holder 33 to the supporting member 251 illustrated in FIG. 2. The flange 334 is a fixing portion that has screw holes 335 for screwing the holder 33 to the supporting member 251.

Each circulation head Hn discharges the inks supplied from the flow channel member 31. Although not illustrated in FIG. 3, each circulation head Hn has nozzles for discharging the first ink and nozzles for discharging the second ink.

The fixing plate 36 is a plate member for fixing the circulation heads Hn to the holder 33. More specifically, the fixing plate 36 is disposed so as to hold the circulation heads Hn with the holder 33, and is fixed to the holder 33 with an adhesive. The fixing plate 36 is made of, for example, a metal material. The fixing plate 36 has openings 361 through which the nozzles of the circulation heads Hn are exposed. FIG. 3 illustrates the openings 361 that are provided for individual circulation heads Hn. The openings in the fixing plate 36 for exposing the nozzles of the circulation heads Hn may be shared by two or more circulation heads Hn.

The reinforcement plate 37 is disposed between the holder 33 and the fixing plate 36, and is fixed to the fixing plate 36 with an adhesive. With this structure, the reinforcement plate 37 reinforces the fixing plate 36. The reinforcement plate 37 has openings 371 in which the circulation heads Hn are mounted. The reinforcement plate 37 is made of, for example, a metal material. For the reinforcement, it is preferable that the thickness of the reinforcement plate 37 be thicker than the thickness of the fixing plate 36.

The cover 38 is a box-shaped member that houses the flow channel structure 311 of the flow channel member 31 and the wiring board 32. The cover 38 is made of, for example, a resin material. The cover 38 has four protrusion holes 381 and an opening 382. Into the protrusion holes 381, the first supply protrusion 312*a*, the second supply protrusion 312*b*, the first discharge protrusion 313*a*, or the second discharge protrusion 313*b* are inserted. Into the opening 382, the connector 35 is inserted.

Figure 4:
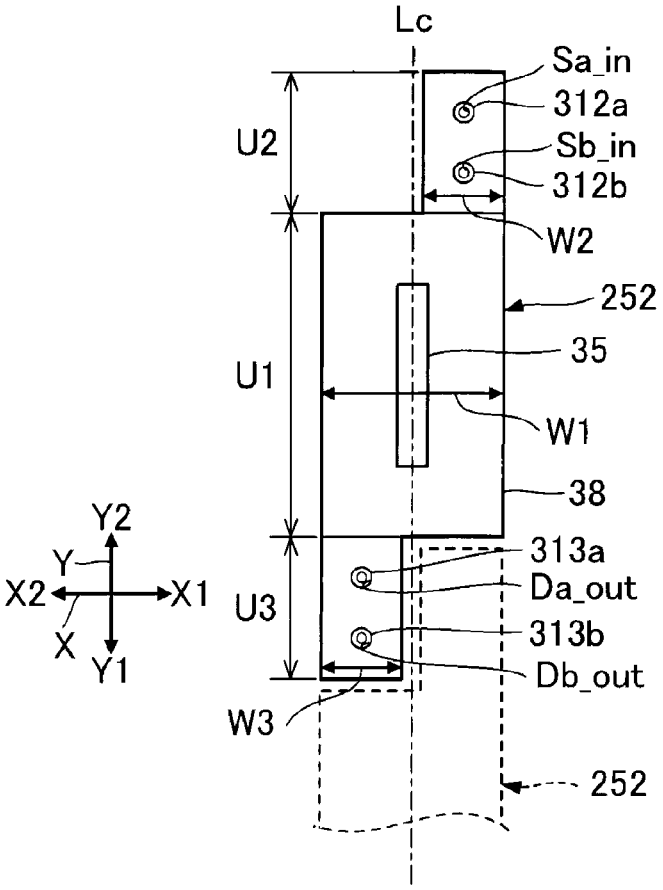
FIG. 4 is a plan view illustrating a liquid ejecting head.

FIG. 4 is a plan view of the head unit 252 viewed from the Z1 direction. As illustrated in FIG. 4, when viewed from the Z1 direction, each head unit 252 has an outer shape that has a first head portion U1, a second head portion U2, and a third head portion U3. The first head portion U1 is between the second head portion U2 and the third head portion U3. More specifically, the second head portion U2 is on the Y2 direction side to the first head portion U1, and the third head portion U3 is on the Y1 direction side to the first head portion U1.

FIG. 4 illustrates a center line Lc that is a line segment that passes through a center of the first head portion U1 along the Y axis. The second head portion U2 is on the X1 direction side to the center line Lc, and the third head portion U3 is on the X2 direction side to the center line Lc. That is, the second head portion U2 and the third head portion U3 are disposed on opposite sides of the center line Lc respectively. Furthermore, the head units 252 are arranged along the Y axis such that the third head portions U3 of respective head units 252 and the second head portions U2 of different head units 252 are adjacent to each other along the X axis. A width W2 of the second head portion U2 along the X axis is shorter than a width W1 of the first head portion U1 along the X axis. Similarly, a width W3 of the third head portion U3 along the X axis is shorter than a width W1 of the first head portion U1 along the X axis. The width W2 and the width W3 illustrated in FIG. 4 are equal. It should be noted that the width W2 and the width W3 may be different. Equal widths W2 and W3 provide increased symmetry in the head units 252, resulting in closely arranged head units 252.

In the first head portion U1, the connector 35 is disposed. In the second head portion U2, the first supply protrusion 312*a* and the second supply protrusion 312*b* are disposed. The first supply protrusion 312*a* and the second supply protrusion 312*b* are arranged along the Y axis. In the third head portion U3, the first discharge protrusion 313*a* and the second discharge protrusion 313*b* are disposed. The first discharge protrusion 313*a* and the second discharge protrusion 313*b* are arranged along the Y axis.

Figure 5:
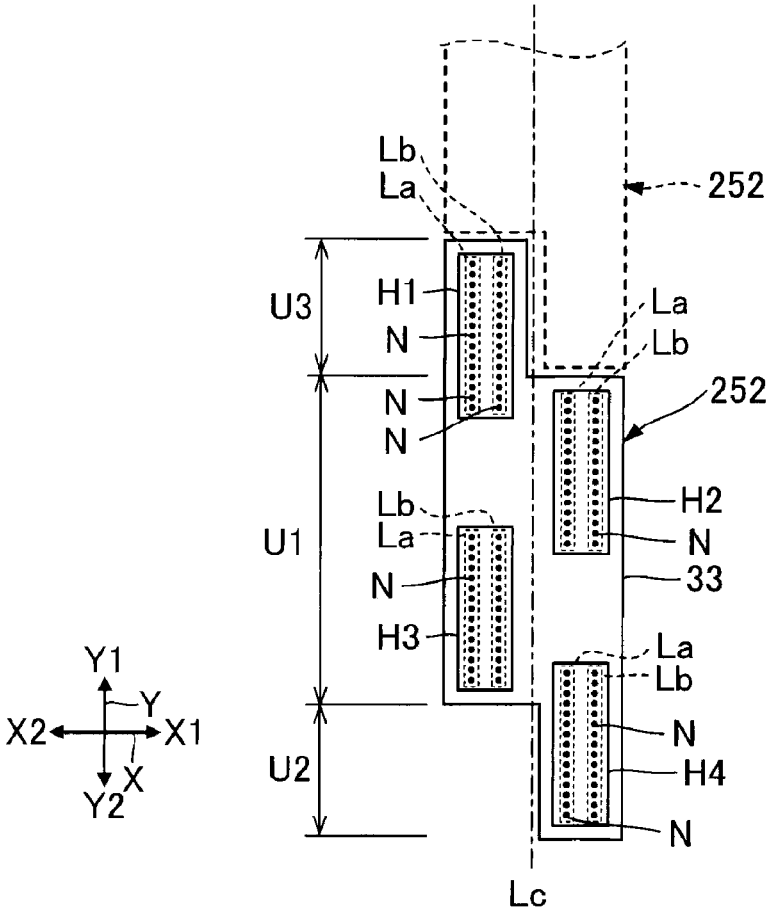
FIG. 5 is a plan view illustrating a liquid discharge head.

FIG. 5 is a plan view of the head unit 252 viewed from the Z2 direction. In FIG. 5, the fixing plate 36 and the reinforcement plate 37 are not illustrated. As illustrated in FIG. 5, the circulation head H1 is disposed across the first head portion U1 and the third head portion U3. The circulation head H2 and the circulation head H3 are disposed in the first head portion U1. The circulation head H4 is disposed across the first head portion U1 and the second head portion U2. The circulation head H1 and the circulation head H3 are on the X2 direction side to the center line Lc, and the circulation head H2 and the circulation head H4 are on the X1 direction side to the center line Lc. A part of the circulation head H1 overlaps with a part of the circulation head H2 on the Y axis. A part of the circulation head H2 overlaps with a part of the circulation head H3 on the Y axis. A part of the circulation head H3 overlaps with a part of the circulation head H4 on the Y axis.

The nozzles N in the circulation heads H1, H2, H3, and H4 are divided into a first nozzle array La and a second nozzle array Lb. Each of the first nozzle array La and the second nozzle array Lb is a group of the nozzles N that are arranged along the Y axis. The first nozzle array La and the second nozzle array Lb are disposed side by side in the X-axis direction with a space therebetween. In the following description, a subscript a is added to reference numerals of components related to the first nozzle array La, and a subscript b is added to reference numerals of components related to the second nozzle array Lb.

Figure 6:
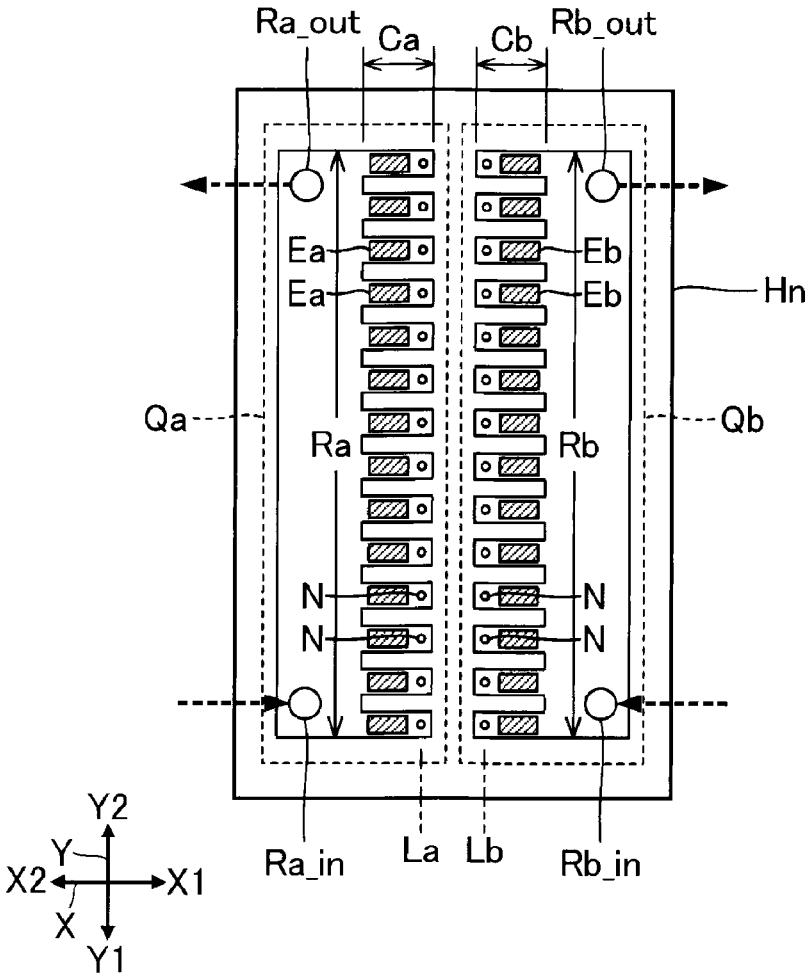
FIG. 6 is a plan view illustrating a structure of a circulation head.

FIG. 6 is a plan view illustrating a structure of the circulation head Hn. FIG. 6 schematically illustrates an internal structure of the circulation head Hn viewed from the Z1 direction. As illustrated in FIG. 6, each circulation head Hn includes a first liquid discharge section Qa and a second liquid discharge section Qb. The first liquid discharge section Qa discharges the first ink supplied from the first sub tank 13*a* from nozzles N in the first nozzle array La. The second liquid discharge section Qb discharges the second ink supplied from the second sub tank 13*b* from nozzles N in the second nozzle array Lb.

The first liquid discharge section Qa includes a first liquid reservoir Ra, pressure chambers Ca, and drive elements Ea. The first liquid reservoir Ra is a common liquid chamber that extends through a plurality of nozzles N in the first nozzle array La. The pressure chamber Ca and the drive element Ea are provided for each nozzle N in the first nozzle array La. The pressure chamber Ca is a space that communicates with the nozzle N. The first ink supplied from the first liquid reservoir Ra is supplied to each of the pressure chambers Ca. The drive element Ea changes the pressure of the first ink in the pressure chamber Ca. For example, the drive element Ea may be a piezoelectric element that deforms a wall surface of the pressure chamber Ca to change the volume of the pressure chamber Ca or a heating element that heats the first ink in the pressure chamber Ca to generate bubbles in the pressure chamber Ca. The drive element Ea changes the pressure of the first ink in the pressure chamber Ca, and thus the first ink in the pressure chamber Ca is ejected from the nozzle N.

Similarly to the first liquid ejecting section Qa, the second liquid ejecting section Qb includes a second liquid reservoir Rb, pressure chambers Cb, and drive elements Eb. The second liquid reservoir Rb is a common liquid chamber that extends through a plurality of nozzles N in the second nozzle array Lb. The pressure chamber Cb and the drive element Eb are provided for each nozzle N in the second nozzle array Lb. The second ink supplied from the second liquid reservoir Rb is supplied to each of the pressure chambers Cb. The drive element Eb may be, for example, the above-mentioned piezoelectric element or the heating element. The drive element Eb changes the pressure of the second ink in the pressure chamber Cb, and thus the second ink in the pressure chamber Cb is ejected from the nozzle N.

Each circulation head Hn has a supply hole Ra_in, a discharge hole Ra_out, a supply hole Rb in, and a discharge hole Rb_out. The supply hole Ra_in and the discharge hole Ra_out communicate with the first liquid reservoir Ra. The supply hole Rb in and the discharge hole Rb_out communicate with the second liquid reservoir Rb.

The first ink that has not been ejected from the nozzles N in the first nozzle array La circulates from the discharge hole Ra_out through the first discharge flow channel Da, the first sub tank 13*a*, the first supply flow channel Sa, the supply hole Ra_in, to the first liquid reservoir Ra. Similarly, the second ink that has not been ejected from the nozzles N in the second nozzle array Lb circulates from the discharge hole Rb_out through the second discharge flow channel Db, the second sub tank 13*b*, the second supply flow channel Sb, the supply hole Rb in, to the second liquid reservoir Rb.

1-4. Structure of Flow Channel Member

Figure 7:
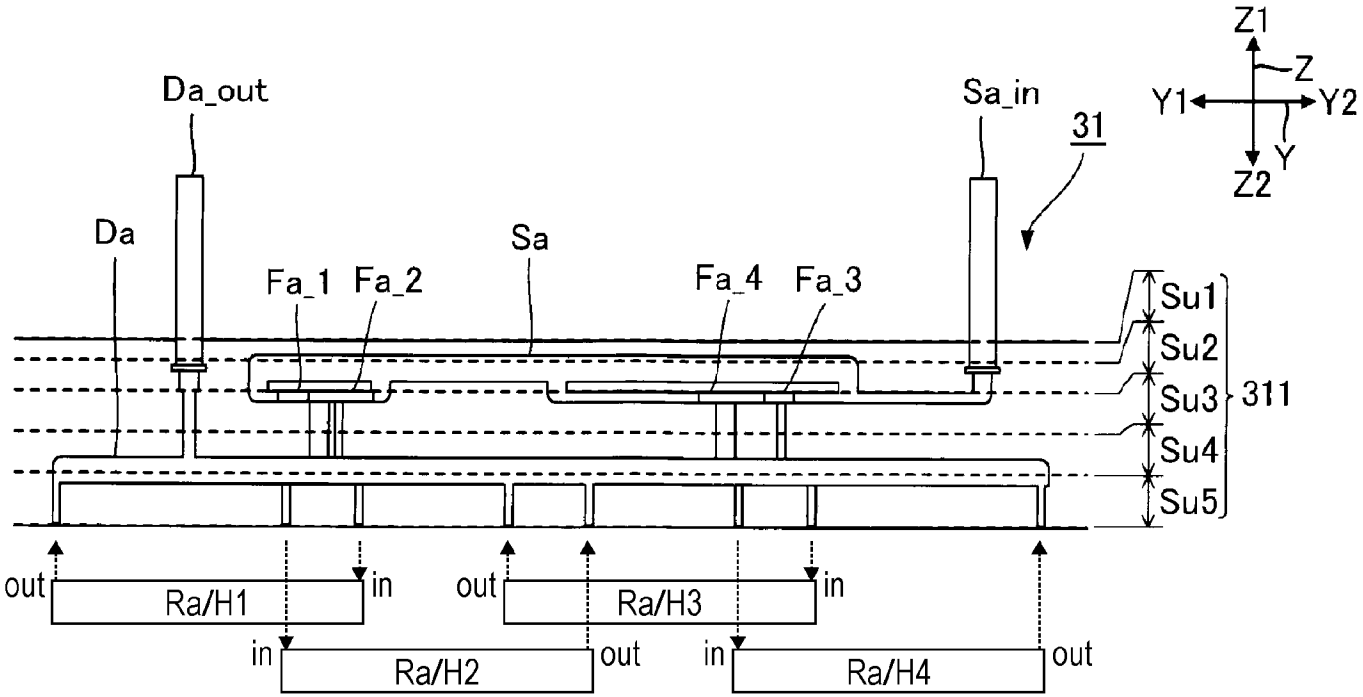
FIG. 7 is a side view illustrating a first supply flow channel and a first discharge flow channel.
Figure 8:
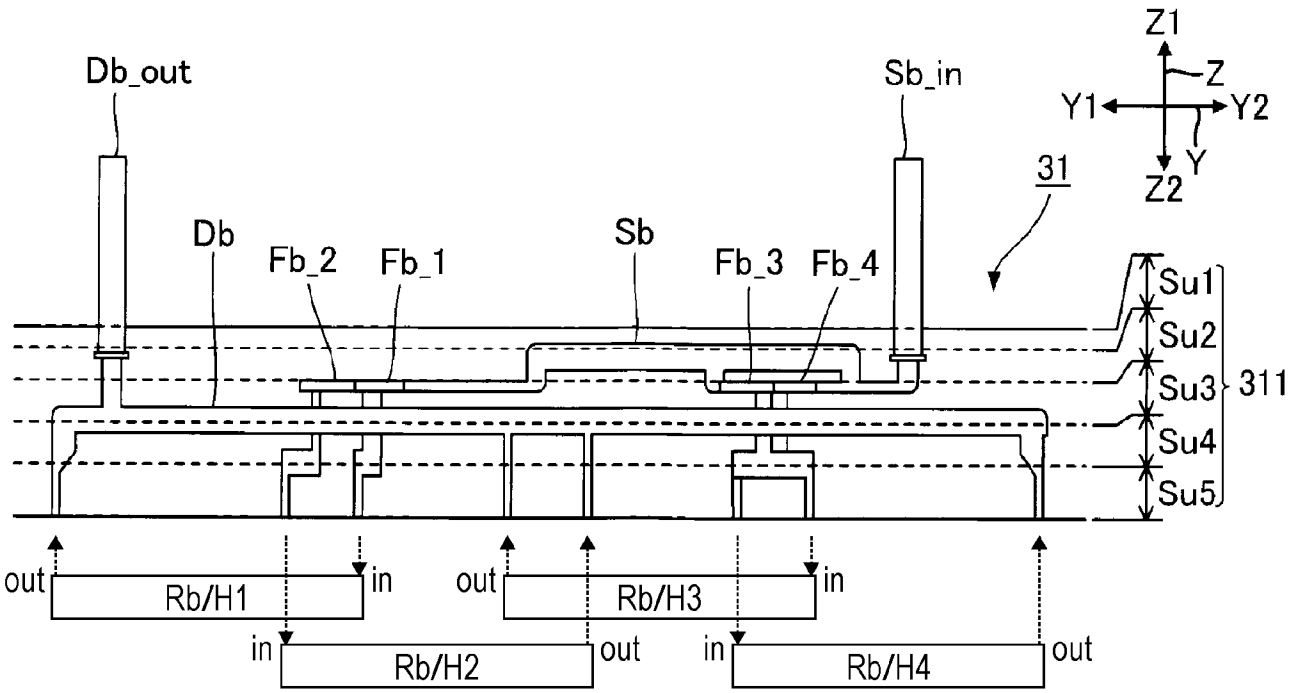
FIG. 8 is a side view illustrating a second supply flow channel and a second discharge flow channel.

FIG. 7 is a side view illustrating the first supply flow channel Sa and the first discharge flow channel Da. FIG. 8 is a side view illustrating the second supply flow channel Sb and the second discharge flow channel Db. In each drawing referred to in the following description, the first liquid reservoir Ra in each circulation head Hn is denoted by "Ra/Hn", and the second liquid reservoir Rb in each circulation head Hn is denoted by "Rb/Hn".

The first supply flow channel Sa, the second supply flow channel Sb, the first discharge flow channel Da, and the second discharge flow channel Db illustrated in FIG. 7 or FIG. 8 are mainly defined by one or both grooves along the X-Y plane in two adjacent substrates Su.

The first supply flow channel Sa illustrated in FIG. 7 is a flow channel from the first supply port Sa_in to the first liquid reservoir Ra in each circulation head Hn. More specifically, the first supply flow channel Sa_includes a space along the X-Y plane between the substrate Su1 and the substrate Su2, a space between the substrate Su2 and the substrate Su3, and holes that extend through the substrates Su3, Su4, and Su5. The holes communicate with the supply hole Ra_in of the circulation head Hn. In the first supply flow channel Sa, four filters Fa_1, Fa_2, Fa_3, and Fa_4 are disposed to catch foreign matter or bubbles mixed in the first ink. In the following description, when it is not necessary to distinguish the filters Fa_1, Fa_2, Fa_3, and Fa_4 from each other, they are referred to as filters Fa. The filters Fa are disposed between the substrate Su2 and the substrate Su3. The filters Fa are made of, for example, a metal or a resin. The filters Fa are provided for each circulation head Hn. The first ink flows through the filters Fa and is supplied to the circulation head Hn.

The first discharge flow channel Da illustrated in FIG. 7 is a flow channel from the first liquid reservoir Ra to the first discharge port Da_out in each circulation head Hn. More specifically, the first discharge flow channel Da has a space between the substrate Su4 and the substrate Su5 and holes that extend through the substrate Su5. The holes communicate with the discharge holes Ra_out in the circulation head Hn. The first discharge flow channel Da has a hole that extends through the substrates Su2, Su3, and Su4 and communicates with the first discharge port Da_out. The first discharge flow channel Da is generally formed in a different layer from the first supply flow channel Sa, and when viewed from a direction along the Z axis, overlaps with the first supply flow channel Sa.

The second supply flow channel Sb illustrated in FIG. 8 is a flow channel from the second supply port Sb_in to the second liquid reservoir Rb in each circulation head Hn. More specifically, the second supply flow channel Sb includes a space between the substrate Su1 and the substrate Su2, a space between the substrate Su2 and the substrate Su3, and holes that extend through the substrates Su3, Su4, and Su5. The holes communicate with the supply holes Rb in in the circulation head Hn. In the second supply flow channel Sb, four filters Fb_1, Fb_2, Fb_3, and Fb_4 are disposed to catch foreign matter or bubbles mixed in the second ink. In the following description, when it is not necessary to distinguish the filters Fb_1, Fb_2, Fb_3, and Fb_4 from each other, they are referred to as filters Fb. The filters Fb are disposed between the substrate Su2 and the substrate Su3. The filters Fb are made of, for example, a metal or a resin. The filters Fb are provided for each circulation head Hn. The second ink flows through the filters Fb and is supplied to the circulation head Hn.

The second discharge flow channel Db illustrated in FIG. 8 is a flow channel from the second liquid reservoir Rb in each circulation head Hn to the second discharge port Db_out. More specifically, the second discharge flow channel Db has a space between the substrate Su3 and the substrate Su4 and holes that extend through the substrate Su4 and the substrate Su5. The holes communicate with the discharge holes Rb_out in the circulation head Hn. The second discharge flow channel Db has a hole that extends through the substrates Su2 and Su3 and communicates with the second discharge port Db_out. The second discharge flow channel Db is generally formed in a different layer from the second supply flow channel Sb, and when viewed from a direction along the Z axis, overlaps with the second supply flow channel Sb.

Figure 9:
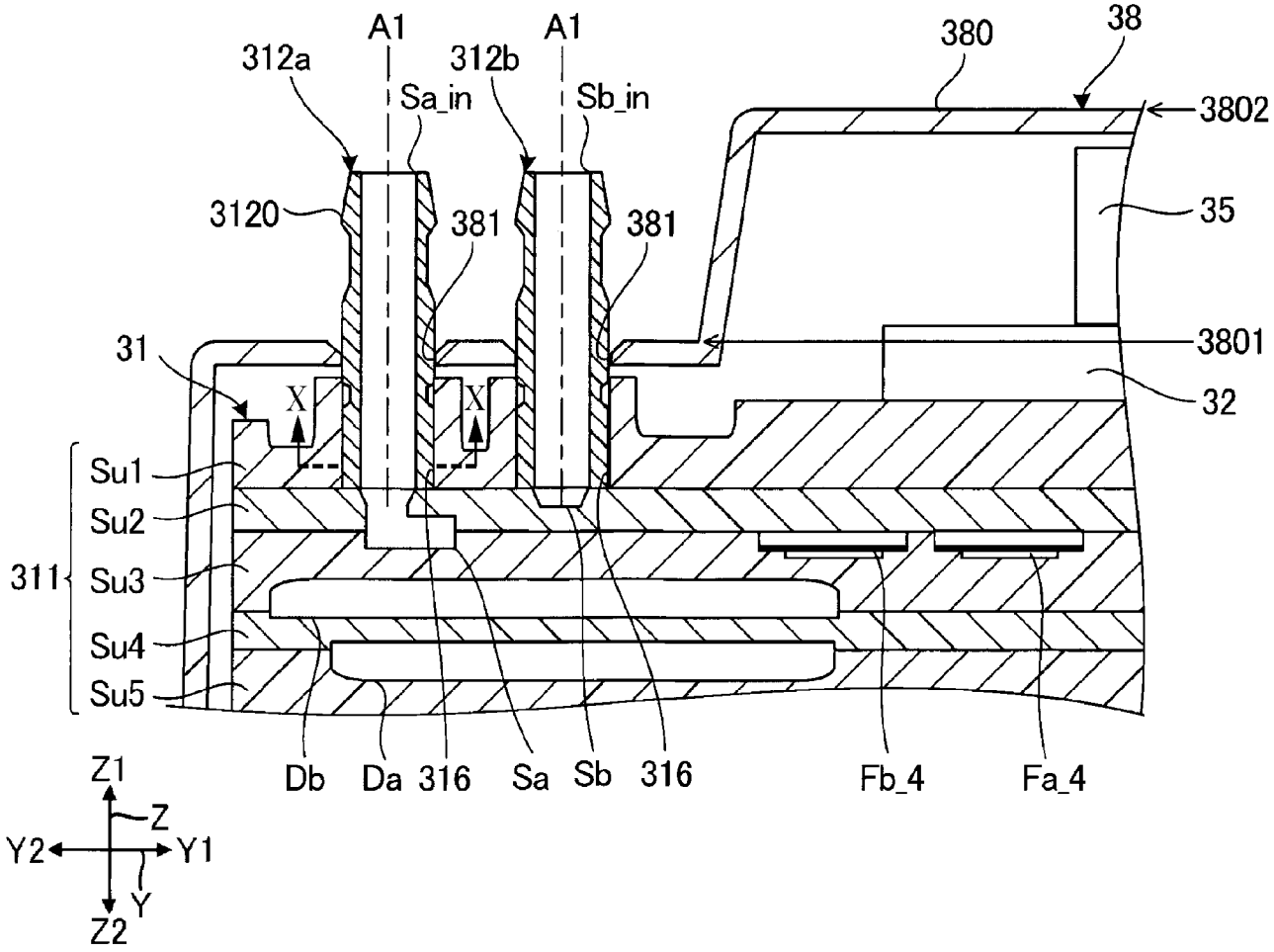
FIG. 9 is an enlarged cross-sectional view illustrating a first supply protrusion and a second supply protrusion.
Figure 10:
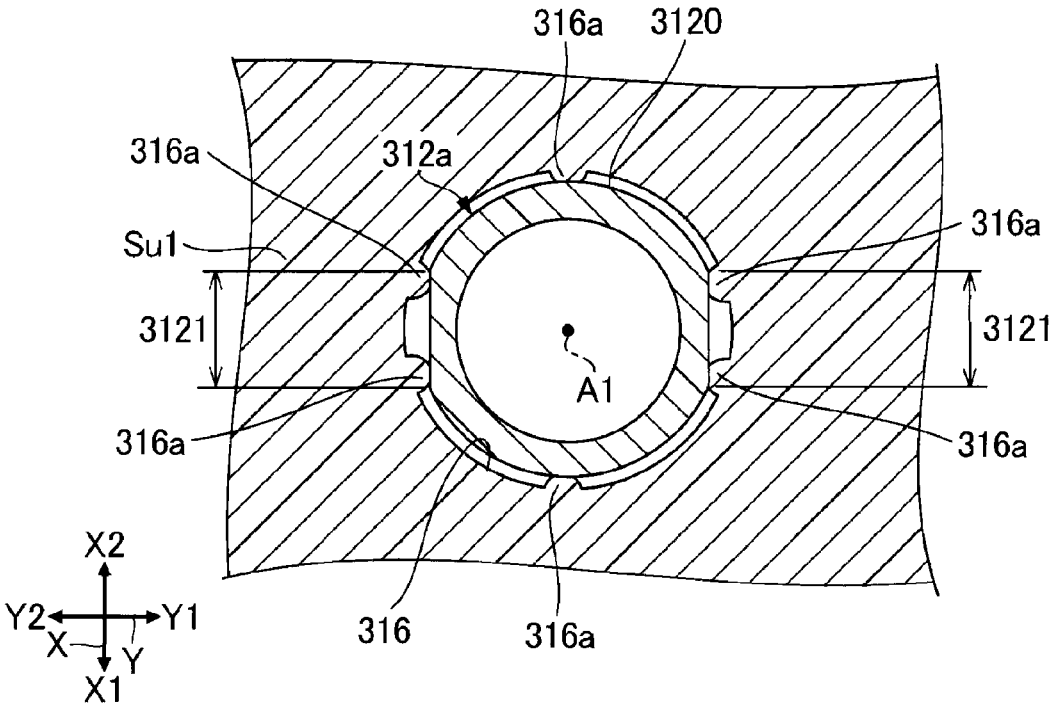
FIG. 10 is a cross-sectional view taken along the line X-X in FIG. 9.

FIG. 9 is an enlarged cross-sectional view illustrating the first supply protrusion 312*a* and the second supply protrusion 312*b*. FIG. 10 is a cross-sectional view taken along the line X-X in FIG. 9. The first supply protrusion 312*a*, the second supply protrusion 312*b*, the first discharge protrusion 313*a*, and the second discharge protrusion 313*b* have similar structures. Thus, in the following description, the first supply protrusion 312*a* will be described as a typical example. Descriptions of the second supply protrusion 312*b*, the first discharge protrusion 313*a*, and the second discharge protrusion 313*b* similar to those of the first supply protrusion 312*a* will be omitted.

As illustrated in FIG. 9, the first supply protrusion 312*a* protrudes from the flow channel structure 311 in the Z1 direction. The first supply protrusion 312*a* is inserted into a through hole 316 in the substrate Su1. A bottom of the first supply protrusion 312*a* is in contact with the substrate Su2. The contact with the substrate Su2 regulates the movement of the first supply protrusion 312*a* in the Z2 direction.

As illustrated in FIG. 10, the first supply protrusion 312*a* has a circular shape when viewed from the Z2 direction. The outer shape of the first supply protrusion 312*a* viewed from the Z2 direction is not limited to the circular shape; alternatively, the outer shape may be an elliptical shape or a polygonal shape. The substrate Su1 has protrusions 316*a* that protrude toward the inside of the through hole 316. The first supply protrusion 312*a* is press-fit into the through hole 316 in the substrate Su1 and is fixed with the protrusions 316*a*. With the first supply protrusion 312*a* attached to the substrate Su1, the substrate Su1 is jointed to the substrate Su2 illustrated in FIG. 9 with an adhesive. The substrate Su1 may have a member for preventing the first supply protrusion 312*a* from coming out in the Z1 direction.

As illustrated in FIG. 10, an outer circumferential surface 3120 of the first supply protrusion 312*a* has two flat surfaces 3121. The flat surfaces 3121 are formed along the X-Z plane. In other words, the flat surfaces 3121 are along a central axis A1 of the first supply protrusion 312*a* along the Y axis. The central axis A1 is an axis along the Z1 direction, which is the protruding direction of the first supply protrusion 312*a*. The flat surfaces 3121 are provided in portions of the first supply protrusion 312*a* in the Z1 direction where the flat surfaces 3121 are in contact with the substrate Su1 illustrated in FIG. 9. The flat surfaces 3121 function as regulating portions for regulating the rotation of the first supply protrusion 312*a* in the circumferential direction. The flat surfaces 3121 of the outer circumferential surface 3120 suppress the rotational deviation of the first supply protrusion 312*a*, and thus the first supply protrusion 312*a* can be stably fixed to the flow channel structure 311. This structure prevents or reduces the adhesive between the first supply protrusion 312*a* and the flow channel structure 311 from coming off, resulting in suppressed ink leakage of the first ink.

The number, orientation, and arrangement of the flat surfaces 3121 are not limited to the illustrated example, and any number, orientation, and arrangement may be employed. For example, the number of the flat surfaces 3121 may be one. Furthermore, in order to regulate the rotation of the first supply protrusion 312*a* in the circumferential direction, on the outer circumferential surface 3120, instead of the flat surfaces 3121, a convex portion or a concave portion may be provided. However, the molding of the flat surfaces 3121 is easier than the molding of the convex portion or the concave portion.

As illustrated in FIG. 9, the first supply protrusion 312*a* is inserted into the protrusion hole 381 of the cover 38. Between the first supply protrusion 312*a* and an inner wall surface of the protrusion hole 381 in the cover 38, an adhesive is applied. The first supply protrusion 312*a* is fixed to the cover 38 with the adhesive. Examples of the adhesive include a silicone adhesive and an epoxy adhesive. It is preferable that the adhesive have high chemical resistance. An adhesive that has high chemical resistance suppresses the dissolution of the adhesive due to the first ink, for example, a solvent ink or a UV ink. Accordingly, the entry of the first ink through the projection hole 381 into the cover 38 can be suppressed.

As illustrated in FIG. 9, an outer surface 380 of the cover 38 has a first surface 3801 and a second surface 3802. The first surface 3801 and the second surface 3802 are along the X-Y plane. The positions of the first surface 3801 and the second surface 3802 are different from each other in the Z1 direction, which is the protruding direction of the first supply protrusion 312*a*. The first surface 3801 is disposed at a position on the Z2 direction side with respect to the second surface 3802. The first surface 3801 and the second surface 3802 are coupled to a step surface that intersects the X-Y plane. The first surface 3801 has the protrusion holes 381.

In the Z1 direction, the first supply port Sa_in of the first supply protrusion 312*a* is disposed between the first surface 3801 and the second surface 3802 of the cover 38. Accordingly, as compared with a structure in which the first supply port Sa_in is disposed on the Z1 direction side with respect to the second surface 3802, damages to the first supply protrusion 312*a* due to stresses to the first supply protrusion 312*a* can be suppressed.

Figure 11:
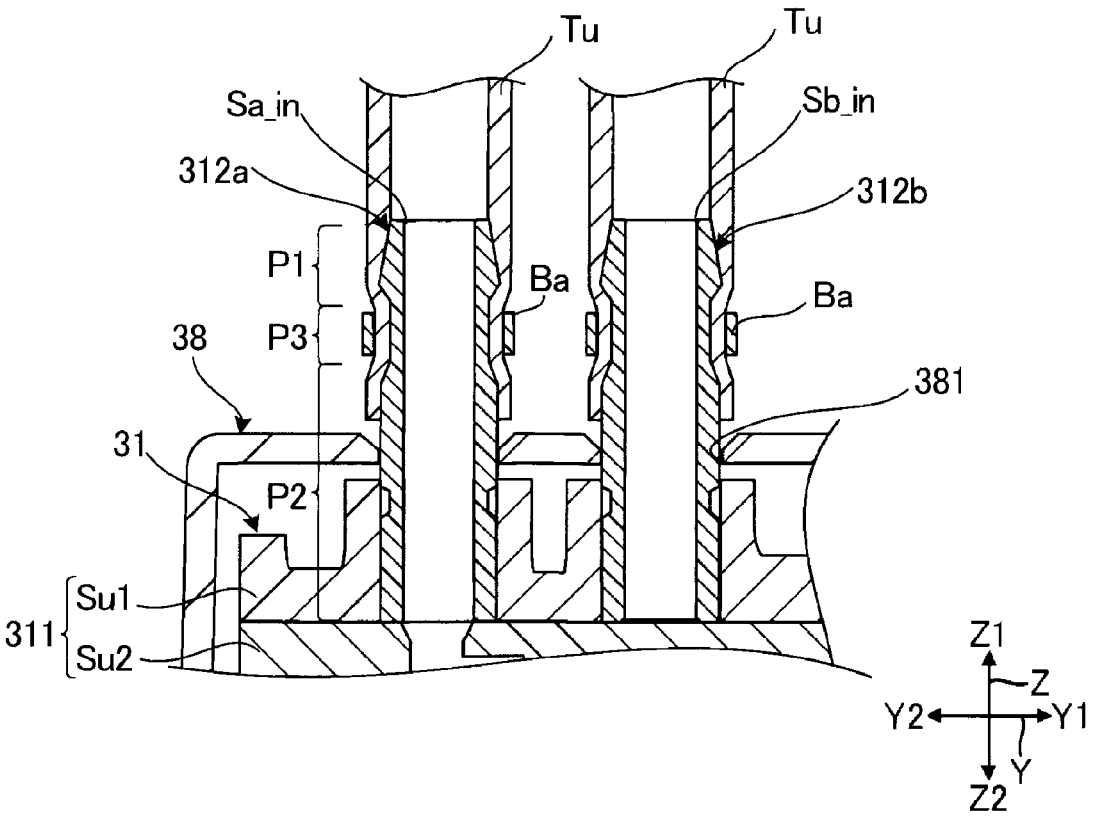
FIG. 11 is a cross-sectional view illustrating a first supply protrusion with a tube attached thereto.

FIG. 11 is a cross-sectional view illustrating the first supply protrusion 312*a* with a tube Tu attached thereto. To the first supply protrusion 312*a* illustrated in FIG. 11, a tube Tu for coupling the first supply protrusion 312*a* to the first liquid container 12*a* illustrated in FIG. 1 is attached. As illustrated in FIG. 11, to a periphery of the tube Tu, a band Ba that functions as a fixing portion for fixing the tube Tu to the first supply protrusion 312*a* is attached. The attached band Ba provides increased tight coupling between the tube Tu and the first supply protrusion 312*a*, suppressing the leakage of the first ink.

The first supply protrusion 312*a* is made of a metal. More specifically, for example, the first supply protrusion 312*a* is made of a stainless steel, whereas, as described above, the flow channel structure 311 is made of a resin. Accordingly, the wall surfaces of the first supply flow channel Sa are made of the resin. For example, the flow channel structure 311 is made of an olefin resin such as polypropylene that contains an inorganic filler such as glass.

In a portion, when a liquid that is highly reactive with the material of the portion adheres to the portion, a stress smaller than the inherent stress resistance of the material may be produced in the portion and the portion may be damaged due to a crack or the like. This phenomenon is called chemical cracking.

As described above, the tube Tu is frequently attached to or detached from the first supply protrusion 312*a*. As a result, the first supply protrusion 312*a* is likely to be subjected to stresses due to the attachment and detachment of the tube Tu. Accordingly, if the first supply protrusion 312*a* is made of a resin and an ink that is highly reactive with the resin such as a solvent ink or a UV ink is used as the first ink, chemical cracking will occur in the first supply protrusion 312*a* due to the stresses.

In this embodiment, however, the first supply protrusion 312*a* is made of a metal. Even when a solvent ink or a UV ink is used as the first ink, metal is less reactive with the ink than resin, that is, the reactivity of metal is low. Accordingly, when a solvent ink or a UV ink is used as the first ink, the chemical cracking in the first supply protrusion 312*a* can be suppressed. With this structure, when a solvent ink or a UV ink is used as the first ink, damages to the first supply protrusion 312*a* can be suppressed.

On the other hand, different from the first supply protrusion 312*a*, the first supply flow channel Sa is rarely stressed. Accordingly, the resin wall surface of the first supply flow channel Sa according to the embodiment is rarely stressed and is not likely to cause chemical cracking. On the contrary, the use of a metal for the wall surface of the first supply flow channel Sa causes increases in weight, processing difficulty, and production cost. Accordingly, in this embodiment, for the wall surface of the first supply flow channel Sa that is less likely to cause chemical cracking, a resin is used to reduce the occurrence of other problems.

The entire first supply protrusion 312*a* according to the embodiment is made of a metal. With this structure, as compared to a structure in which a part of the first supply protrusion 312*a* is made of a metal, the stiffness of the first supply protrusion 312*a* can be increased. A structure in which at least a part of the first supply protrusion 312*a* is made of a metal can similarly reduce damages to the first supply protrusion 312*a* as compared with a structure in which the entire first supply protrusion 312*a* is made of a resin.

The first supply protrusion 312*a* is manufactured, for example, by performing cutting processing and then chemically polishing its inner wall surface. The chemical polishing can flatten irregularities due to processing marks and burrs at the ends. As a result, mixing of metallic foreign matter due to processing marks into the flow channel can be reduced. The first supply protrusion 312*a* may be manufactured, for example, by metal injection molding (MIM). MIM can reduce generation of metallic foreign matter due to processing marks. Alternatively, the first supply protrusion 312*a* may be manufactured, for example, by drawing. Similarly, by drawing, generation of metallic foreign matter due to processing marks can be reduced.

As described above, the flow channel structure 311 is made of a resin. Accordingly, the flow channel structure 31 lighter than a metal flow channel structure 311 can be achieved. It should be noted that at least the wall surface of the first supply flow channel Sa may be made of a resin. In such a case, in the flow channel structure 311, the components made of a metal may be covered with a resin.

The flow channel structure 311 has, as described above, the filters Fa. In this embodiment, the filter Fa illustrated in FIG. 9 is welded to the flow channel structure 311 with a resin. The resin is the same as the resin of the flow channel structure 311. That is, with the flow channel structure 311 made of a resin, the filter Fa can be welded with the resin. For example, the operation of welding the filter Fa to a metal flow channel structure 311 with a metal is more difficult than the operation of welding the filter Fa to the resin flow channel structure 311 with the resin. Although the filter Fa may be welded to a metal flow channel structure 311 with an adhesive, the variety of adhesives is limited and the design freedom is decreased. Furthermore, when the filter Fa is joined with an adhesive, the adhesive may flow into the flow channel, causing a pressure loss in flow channel resistance. To solve the problem, the flow channel structure 311 made of the resin is employed, and thus the filters Fa can be readily joined with the resin and the flowing-out of adhesive can be prevented or reduced. Accordingly, the manufacturing process can be expedited and simplified.

Figure 12:
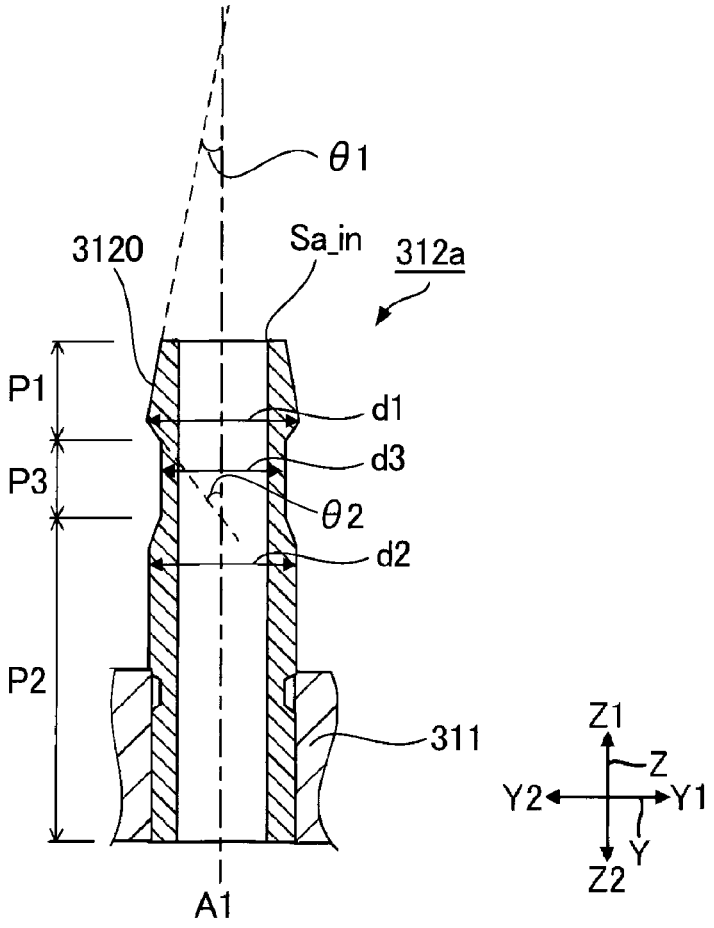
FIG. 12 is a cross-sectional view illustrating a first supply protrusion.

FIG. 12 is a cross-sectional view illustrating the first supply protrusion 312*a*. As illustrated in FIG. 12, the first supply protrusion 312*a* has a first portion P1, a second portion P2, and a third portion P3. Among the first portion P1, the second portion P2, and the third portion P3, the first portion P1 is a tip of the first supply protrusion 312*a*. The first supply port Sa_in is at the tip of the first portion P1. The second portion P2 is closer to the flow channel structure 311 than the first portion P1. The third portion P3 is between the first portion P1 and the second portion P2. An outer diameter d3 of the third portion P3 is smaller than each of an outer diameter d1 of the first portion P1 and an outer diameter d2 of the second portion P2. The outer diameters d1, d2, and d3 are maximum diameters respectively.

The third portion P3 is disposed between the first portion P1 and the second portion P2, forming a recessed portion between the first portion P1 and the second portion P2. The recessed portion enables the tube Tu to be stably fixed to the first supply protrusion 312*a* with the band Ba illustrated in FIG. 11 as compared with a first supply protrusion 312*a* that is not provided with the recessed portion. The second portion P2 that has the outer diameter d2 larger than the outer diameter d3 prevents or reduces the tube Tu from being readily detached from the first supply protrusion 312*a* as compared with a structure in which an outer diameter of the third portion P3 to the bottom of the first supply protrusion 312*a* is the outer diameter d3.

As illustrated in FIG. 12, in the first portion P1, the outer circumferential surface 3120 of the first supply protrusion 312*a* is inclined with respect to the central axis A1 in a cross section of the first supply protrusion 312*a* taken along the Y-Z plane that includes the central axis A1. More specifically, the outer circumferential surface 3120 gradually widens from the first supply port Sa_in toward the flow channel structure 311, and gradually narrows. The outer circumferential surface 3120 in the first portion P1 widens from the first supply port Sa_in at the tip of the first supply protrusion 312*a* toward the flow channel structure 311 at a first angle θ1, and then narrows at a second angle θ2. The first angle θ1 is within a range $0° < \theta 1 < 90°$. The second angle θ2 is within a range $\theta 1 < \theta 2 < 90°$. Each of the first angle θ1 and the second angle θ2 is formed by the central axis A1 and the outer circumferential surface 3120 in a cross section of the first supply protrusion 312*a* taken along the Y-Z plane that includes the central axis A1. The first portion P1 enables the tube Tu to be readily attached to the first supply protrusion 312*a*, and to be not readily detached from the first supply protrusion 312*a*.

In this embodiment, the second angle θ2 is less than 90°, but the second angle θ2 may be 90°. With the first supply protrusion 312*a* having such angle, the tube Tu is not readily detached from the first supply protrusion 312*a*. In the second portion P2, the outer circumferential surface 3120 of the first supply protrusion 312*a* has a portion that gradually widens from the third portion P3 toward the flow channel structure 311 in the cross section of the first supply protrusion 312*a* taken along the Y-Z plane that includes the central axis A1. With this structure, the tube Tu can be readily attached as compared with a structure in which the portion is not provided.

As described above, the descriptions of the first supply protrusion 312*a* similarly apply to descriptions of the second supply protrusion 312*b*, the first discharge protrusion 313*a*, and the second discharge protrusion 313*b*. Accordingly, the first discharge protrusion 313*a* is made of a metal. With this structure, even when a solvent ink or a UV ink is used as the first ink in the first discharge protrusion 313*a* that is likely to be subjected to stresses due to the attachment and detachment of the tube Tu, the occurrence of chemical cracking can be reduced and damages to the first discharge protrusion 313*a* can be suppressed. On the other hand, the first discharge flow channel Da that is less likely to be subjected to stresses is not likely to cause chemical cracking, and thus, the wall surface made of a resin can prevent an increase in weight and other problems.

2. Second Embodiment

A second embodiment will be described. In the following examples, the reference numerals used in the first embodiment will apply to components that function similarly to those in the first embodiment, and detailed descriptions of the components will be omitted as appropriate.

Figure 13:
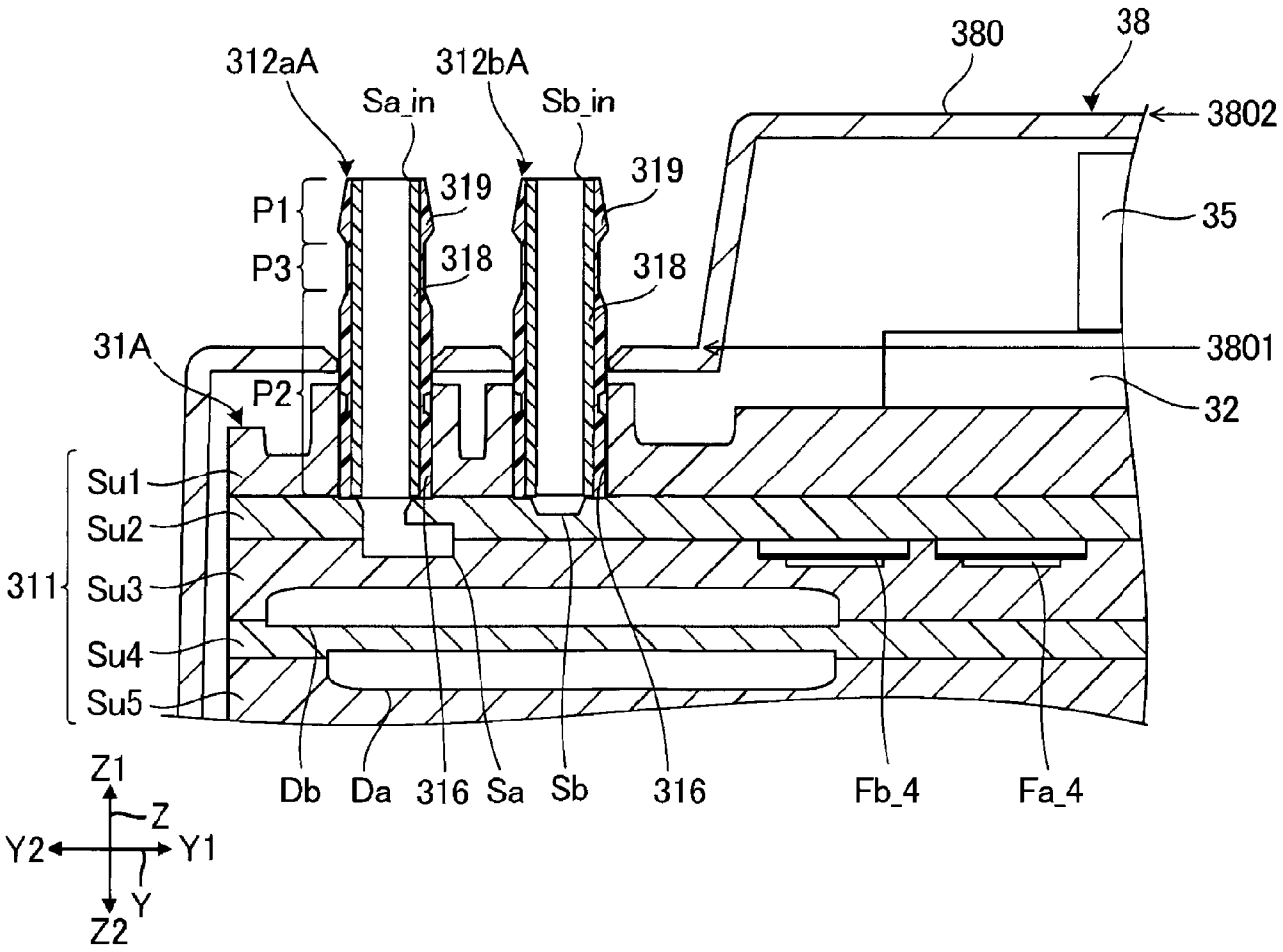
FIG. 13 is an enlarged cross-sectional view illustrating a first supply protrusion and a second supply protrusion according to a second embodiment.

FIG. 13 is an enlarged cross-sectional view illustrating a first supply protrusion 312*a*A and a second supply protrusion 312*b*A. The first supply protrusion 312*a*A and the second supply protrusion 312*b*A have similar structures. Although not illustrated, structures of the first discharge protrusion 313*a* and the second discharge protrusion 313*b* according to the embodiment are similar to the structure of the first supply protrusion 312*a*A. Thus, in the following description, the first supply protrusion 312*a*A will be described as a typical example.

As illustrated in FIG. 13, a flow channel member 31A has a first tubular member 318 and a second tubular member 319. The second tubular member 319 surrounds the first tubular member 318. In other words, the first tubular member 318 is disposed inside the second tubular member 319. The first tubular member 318 is made of a metal. The second tubular member 319 is made of a resin. Accordingly, an inner wall surface of the first supply protrusion 312*a*A is made of the metal and an outer wall surface of the first supply protrusion 312*a*A is made of the resin. The first supply protrusion 312*a*A is formed, for example, by insert molding.

The first supply protrusions 312*a*A that has the metal first tubular member 318 can prevent or reduce damages to the first supply protrusions 312*a*A as compared to a structure in which the entire first supply protrusion 312*a*A is made of a resin. Furthermore, the first supply protrusion 312*a*A that has the metal inner wall surface can prevent a decrease in stiffness of the first supply protrusion 312*a*A due to the first ink, for example, a solvent ink or a UV ink. With this structure, damages to the first supply protrusion 312*a*A can be suppressed over a long period of time.

The first supply protrusion 312*a*A may further include a tubular member in addition to the first tubular member 318 and the second tubular member 319. For example, the first supply protrusion 312*a*A may further include a third tubular member that surrounds the second tubular member 319.

3. Modifications

The above-described embodiments may be modified in various ways. Specific modifications applicable to the above-described embodiments will be described below. Two or more modifications selected from those below may be combined without a contradiction therebetween.

Figure 14:
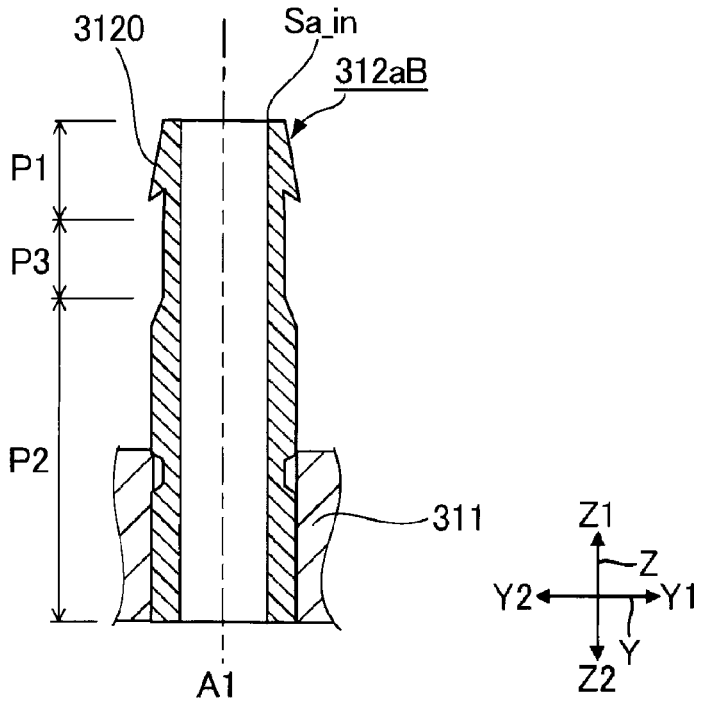
FIG. 14 is a cross-sectional view illustrating a first supply protrusion according to a modification.

FIG. 14 is a cross-sectional view illustrating a first supply protrusion 312*a*B according to a modification. As illustrated in FIG. 14, in the first portion P1, the outer circumferential surface 3120 of the first supply protrusion 312*a*B may gradually widen from the first supply port Sa_in toward the flow channel structure 311, and may gradually incline with respect to the central axis A1 to return toward the first supply port Sa_in. This similarly applies to the second supply protrusion 312*b*, the first discharge protrusion 313*a*, and the second discharge protrusion 313*b*.

In the above-described embodiments, the first supply flow channel Sa and the first discharge flow channel Da are not coupled to each other in the flow channel structure 311; however, the first supply flow channel Sa and the first discharge flow channel Da may be coupled to each other in the flow channel structure 311. This similarly applies to the second supply flow channel Sb and the second discharge flow channel Db.

In the above-described embodiments, the head unit 252 includes the first discharge flow channel Da, the second discharge flow channel Db, the first discharge protrusion 313*a*, and the second discharge protrusion 313*b*; however, these components may be omitted. That is, the "liquid ejecting head unit" may include no mechanism for circulating a liquid.

In the above-described embodiments, the number of the circulation heads Hn in the head unit 252 is not limited to four, and may be one or more other than three.

In the above-described embodiments, the shape of the head unit 252 viewed from the Z1 direction is not limited to the shape illustrated in FIG. 3, and may be any shape. For example, the shape of the head unit 252 viewed from the Z1 direction may be a quadrilateral shape. Accordingly, the shape of the head unit 252 is not limited to a shape that has the first head portion U1, the second head portion U2, and the third head portion U3.

In the above-described embodiments, as illustrated in FIG. 7 and FIG. 8, generally, the first discharge flow channel Da and the second discharge flow channel Db are provided in layers below the layers in which the first supply flow channel Sa and the second supply flow channel Sb are provided. However, the arrangement of the first supply flow channel Sa, the second supply flow channel Sb, the first discharge flow channel Da, and the second supply flow channel Db is not limited to the illustrated example. For example, the first discharge flow channel Da and the second discharge flow channel Db may be provided in the same layer.

In the first embodiment, the first supply protrusion 312*a* has the first portion P1, the second portion P2, and the third portion P3, but the first supply protrusion 312*a* may not include the portions. The outer circumferential surface 3120 of the first supply protrusion 312*a* may be parallel to the central axis A1 in the cross section of the first supply protrusion 312*a* taken along the Y-Z plane that includes the central axis A1. This applies to the first supply protrusion 312*a*A according to the second embodiment.

In the above-described embodiments, in the first portion P1, the outer circumferential surface 3120 is inclined with respect to the central axis A1, but the outer circumferential surface 3120 may not be inclined with respect to the central axis A1.

In the above-described embodiments, the outer surface 380 of the cover 38 includes the first surface 3801 and the second surface 3802 and the step surface that couples the first surface 3801 and the second surface 3802. In other words, the outer surface 380 of the cover 38 has a step. The cover 38, however, may not have the step.

In the first embodiment, the first supply protrusion 312*a* is disposed between the first surface 3801 and the second surface 3802 of the cover 38, but the first supply protrusion 312*a* may be disposed on the Z1 direction side with respect to the second surface 3802. More specifically, the first supply protrusion 312*a* may protrude more in the Z1 direction than the second surface 3802, which is the uppermost surface of the cover 38. This similarly applies to the first supply protrusion 312*a*A according to the second embodiment.

A "liquid ejecting head unit" may include at least a "flow channel member" and a "liquid ejecting head" for ejecting a liquid. For example, the head unit 252 according to the embodiments may not include the reinforcement plate 37.

In the above-described embodiments, different inks are supplied to the first supply flow channel Sa and the second supply flow channel Sb respectively, but the same ink may be supplied to the first supply flow channel Sa and the second supply flow channel Sb.

The above-described embodiments employ the serial liquid ejecting apparatus that reciprocates the transport member 241 with the head unit 252 mounted thereon, but the present disclosure may be applied to a line liquid ejecting apparatus that has nozzles N to cover the entire width of a medium 11.

The above-described embodiments include the sub tank 13 that is disposed outside the head unit 252 and the ink is circulated through the head unit 252 and the sub tank 13, but a system that circulates the ink through the outside of the head unit 252 other than the sub tank may be employed. For example, the ink may be circulated through the head unit 252 and the liquid container 12.

In the above-described embodiments, in both of the supply protrusions and the discharge protrusions, at least a part of each supply protrusion and at least a part of each discharge protrusion are made of a metal; however, in one of the supply protrusions and the discharge protrusions, at least a part of each supply protrusion or at least a part of each discharge protrusion may be made of a metal.

The liquid discharge apparatuses having the liquid discharge head unit according to any one of the above-described embodiments may be applied to devices dedicated for printing, and various devices such as facsimile apparatuses and copying machines. It should be noted that the usage of the liquid discharge apparatuses having the liquid ejecting head unit is not limited to printing. For example, the liquid ejecting apparatuses that have the liquid ejecting head unit for ejecting solutions of coloring materials can be used as manufacturing apparatuses for producing color filers for display apparatuses such as liquid crystal display panels. The liquid ejecting apparatuses that have the liquid ejecting head unit for ejecting a solution of a conductive material can be used as manufacturing apparatuses for producing wires and electrodes of wiring boards. The liquid ejecting apparatuses that have the liquid ejecting head unit for ejecting a solution of an organic substance related to a living body can be used, for example, as manufacturing apparatuses for manufacturing biochips.

What is claimed is:

1. A liquid ejecting head unit configured to eject a liquid comprising:

a flow channel member; and a liquid ejecting head configured to eject the liquid supplied from the flow channel member, the flow channel member includes a flow channel structure having a supply flow channel through which the liquid supplied from the outside flows, and a supply protrusion that protrudes from the flow channel structure and has a supply port for supplying the liquid from the outside to the supply flow channel, the flow channel structure also having a discharge flow channel through which the liquid to be discharged to the outside flows, the flow channel member further includes a discharge protrusion that protrudes from the flow channel structure and has a discharge port for discharging the liquid from the discharge flow channel to the outside, wherein a wall surface of the supply flow channel is made of a resin, and at least a part of the supply protrusion and a least a part of the discharge protrusion is made of a metal.

2. The liquid ejecting head unit according to claim 1, wherein an outer circumferential surface of the supply protrusion gradually widens from the supply port toward the flow channel structure at a first angle θ1 that is formed by the outer circumferential surface and an axis along a protruding direction of the supply protrusion, wherein the first angle θ1 is 0° <01<90°, and gradually narrows at a second angle that is formed by the outer circumferential surface and the axis, wherein the second angle θ2 is 01<02<90°.

3. The liquid ejecting head unit according to claim 1, wherein a filter is welded with the resin to the flow channel structure.

4. The liquid ejecting head unit according to claim 1, further comprising:

a cover that covers the flow channel member, wherein an outer surface of the cover has a first surface having a protrusion hole into which the supply protrusion is inserted, and a second surface disposed at a position different from a position of the first surface in a protruding direction of the supply protrusion, and in the protruding direction, the supply port is disposed between the first surface and the second surface.

5. The liquid ejecting head unit according to claim 1, wherein the reactivity of the metal with the liquid is lower than the reactivity of the resin with the liquid.

6. The liquid ejecting head unit according to claim 1, wherein an outer circumferential surface of the supply protrusion has a regulating portion configured to regulate rotation of the supply protrusion in a circumferential direction.

7. A liquid ejecting head unit configured to eject a liquid comprising:

a flow channel member; and a liquid ejecting head configured to eject the liquid supplied from the flow channel member, the flow channel member includes a flow channel structure having a supply flow channel through which the liquid supplied from the outside flows, and a supply protrusion that protrudes from the flow channel structure and has a supply port for supplying the liquid from the outside to the supply flow channel, wherein a wall surface of the supply flow channel is made of a resin, at least a part of the supply protrusion is made of a metal, the supply protrusion includes a first tubular member made of the metal and a second tubular member that surrounds the first tubular member and is made of the resin.

8. A liquid ejecting head unit configured to eject a liquid comprising:

a flow channel member; and a liquid ejecting head configured to eject the liquid supplied from the flow channel member, the flow channel member includes a flow channel structure having a supply flow channel through which the liquid supplied from the outside flows, and a supply protrusion that protrudes from the flow channel structure and has a supply port for supplying the liquid from the outside to the supply flow channel, wherein a wall surface of the supply flow channel is made of a resin, at least a part of the supply protrusion is made of a metal, and the supply protrusion includes a first portion;

a second portion that is closer to the flow channel structure than the first portion; and a third portion that is a portion between the first portion and the second portion and has an outer diameter smaller than each of an outer diameter of the first portion and an outer diameter of the second portion.

* * * * *